US006575212B2

(12) United States Patent
Terpstra et al.

(10) Patent No.: US 6,575,212 B2
(45) Date of Patent: Jun. 10, 2003

(54) ADJUSTABLE HEIGHT WORKSTATION

(75) Inventors: Paul D. Terpstra, Janesville, WI (US); Lee K. Hilgendorf, Milton, WI (US)

(73) Assignee: Gilman Engineering & Manufacturing Co. LLC, Janesville, WI (US)

( * ) Notice: Subject to any disclaimer, the term of this patent is extended or adjusted under 35 U.S.C. 154(b) by 0 days.

(21) Appl. No.: 09/844,509

(22) Filed: Apr. 27, 2001

(65) Prior Publication Data

US 2002/0002799 A1 Jan. 10, 2002

Related U.S. Application Data

(60) Provisional application No. 60/200,788, filed on Apr. 28, 2000.

(51) Int. Cl.[7] ..... B25H 1/00

(52) U.S. Cl. ..... 144/286.5; 408/87; 408/234; 409/235

(58) Field of Search ..... 144/286.5, 135.2, 144/135.3; 108/96, 147.11, 147.18; 408/87, 130, 234; 409/235; 248/125.1, 125.3, 295.11, 298.1

(56) References Cited

U.S. PATENT DOCUMENTS

| | | | | | |
|---|---|---|---|---|---|
| 324,688 | A | * | 8/1885 | Rockwell | 144/135.3 |
| 1,915,727 | A | * | 6/1933 | Friedemnn | 108/96 |
| 2,835,289 | A | * | 5/1958 | Harstrom et al. | 144/117.1 |
| 2,887,907 | A | * | 5/1959 | Lauck | 408/130 |
| 3,555,963 | A | * | 1/1971 | Evans | 29/26 A |
| 3,710,735 | A | | 1/1973 | Litvinoff et al. | 108/146 |
| 3,916,726 | A | * | 11/1975 | Springer | 408/241 G |
| 3,976,016 | A | | 8/1976 | Longbottom | 108/144 |
| 4,284,373 | A | * | 8/1981 | Wolff | 408/129 |
| 4,371,075 | A | | 2/1983 | Erlichman | 198/345 |
| 4,619,541 | A | | 10/1986 | Lovering | 403/49 |
| 5,036,776 | A | | 8/1991 | Veyhl et al. | 108/7 |
| 5,125,139 | A | * | 6/1992 | Ohta | 29/26 A |
| 5,413,440 | A | * | 5/1995 | Willson et al. | 408/111 |
| 5,553,550 | A | | 9/1996 | Doyle | 108/144 |
| 5,575,598 | A | * | 11/1996 | Abe et al. | 409/304 |
| 5,890,523 | A | | 4/1999 | Johnson | 144/286.5 |
| 5,894,805 | A | | 4/1999 | Raasch et al. | 108/146 |
| 5,961,179 | A | | 10/1999 | Dixon et al. | 297/173 |
| 5,979,521 | A | | 11/1999 | Garcia | 144/129 |

* cited by examiner

*Primary Examiner*—Allen Ostrager
*Assistant Examiner*—Shelley Self
(74) *Attorney, Agent, or Firm*—Foley & Lardner

(57) ABSTRACT

A workstation having an adjustable support structure is disclosed. The workstation includes a beam, a position locking apparatus, and a workpiece-supporting device slideable along the beam to a position where it is locked by the locking apparatus. The locking apparatus is configured to exert a constraining force proportional to a load force. Also disclosed is a workstation including a means for supporting a workpiece, a means for supporting a means for supporting the workpiece at a selected distance above a floor, and a means for frictionally securing the means for supporting the workpiece to the means for supporting the means for supporting the workpiece. Also disclosed is a workstation including a vertically disposed support member and at least one tooling plate assembly including a position securing apparatus for securing the tooling plate assembly in a selected vertical position and including wedging surfaces cooperating in frictionally securing the tooling plate assembly to the support member, wherein the securing force corresponds to the loading force.

20 Claims, 6 Drawing Sheets

FIG. 7
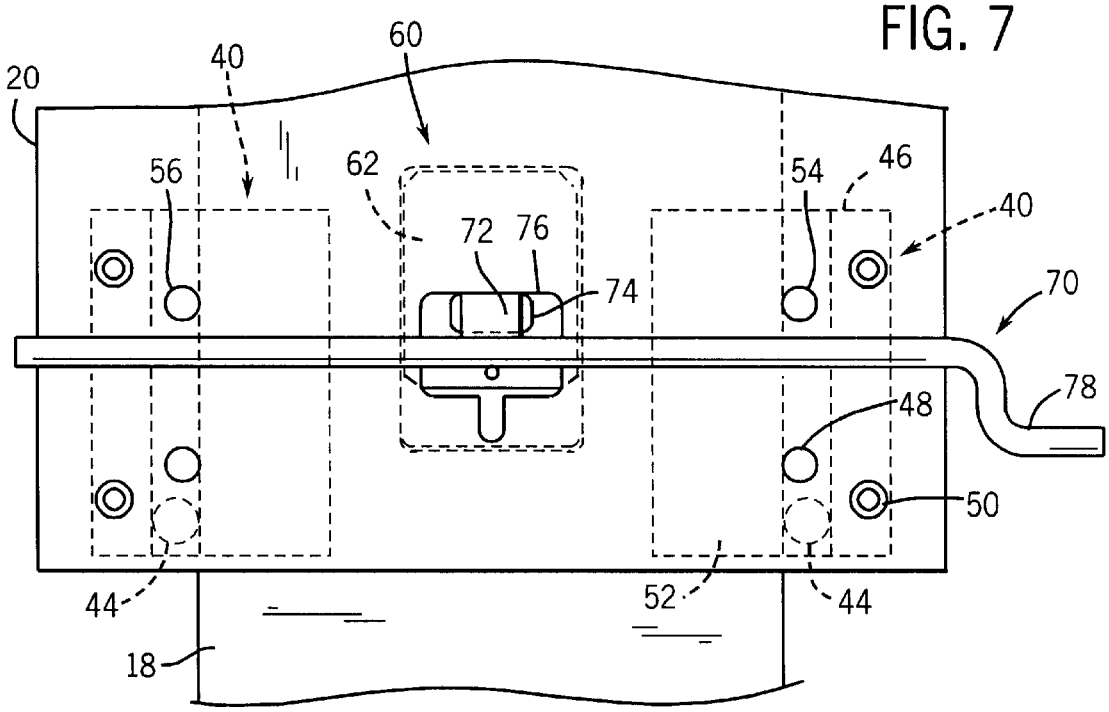
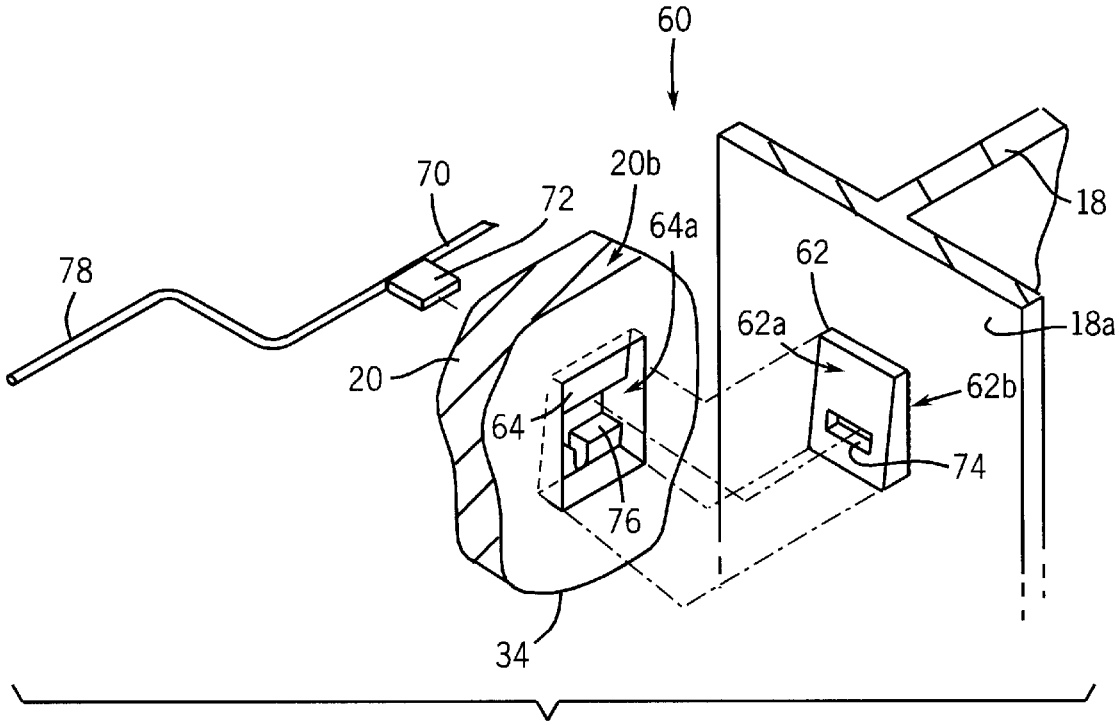
FIG. 8

ADJUSTABLE HEIGHT WORKSTATION

This application claims priority of U.S. Serial No. 60/200,788, filed April 28, 2000.

A. FIELD OF THE INVENTION

The present invention generally relates to the field of workstations, and more particularly to heavy duty workstations for modular assembly cells having work surfaces of which the height above a supporting floor is adjustable.

B. BACKGROUND OF THE INVENTION

Workstations, also known as manufacturing cells, are often used in manufacturing facilities for operations on workpieces and for assembling parts to form assemblies or subassemblies. Workstations may be configured in a manner similar to that of conventional workbenches, typically having a generally flat work surface or platform for holding a workpiece while performing manufacturing operations such as fabricating, drilling, assembling, etc. Workstations may also be configured to include manufacturing tooling (e.g., an air cylinder, a power drill, screwdriver, or nut runner, riveting or spot-welding apparatus, etc.), instrumentation and/or control apparatus (e.g., for monitoring and controlling a manufacturing process or characteristic of the workpiece), parts and product bins, trays, conveyors, etc.

In the past, workstations were typically designed and built for a particular manufacturing application or procedure. In most cases, the height of the work platform is fixed. The workstation or cell is normally constructed by mounting a support structure to a table. The table may be constructed from welded steel, or assembled from aluminum extrusion or steel tubing. The workstation tooling is typically mounted to the support structure in a fixed location above the work platform at an average height normally required for the assembly operation. Since each workstation is normally associated with a particular manufacturing function and a unique workpiece, the height of the support structure necessarily varies for nearly every workstation. The type of the tooling also varies from workstation to workstation. Hence, numerous different designs for the workstation support structure are often required to accommodate a single manufacturing line.

Furthermore, different workstation operators may be assigned at different times to work at a particular workstation, and all operators are obviously not the same height. Since a particular workstation may be used for assembling different products having different heights at different times, it is therefore desirable for the height of the working surface to be adjustable above the floor. Preferably, the height would be infinitesimally adjustable, or at least adjustable in small increments to accommodate all operators. Most fixed-height workstation constructions are not easily re-configurable to make them adjustable in height. The fixed working height of most known workstations creates a less than ideal ergonomic situation for the operators.

Some commercially available workstations are designed to have work surfaces adjustable in height. However, such workstations have numerous disadvantages. First, adjustable-height workstations have generally been of relatively small capacities in terms of weight and force that the adjustable work surface can support, e.g., often having a support capacity of less than 1000 pounds. Second, those few heavy-duty workstations that are height-adjustable are usually only adjustable in large increments. Third, such heavy-duty workstations have been relatively expensive. Fourth, those workstations that are infinitesimally adjustable in height are usually not heavy duty, and therefore tend to slip under increased loads. Fifth, known workstations often require a difficult or involved procedure to adjust the height to a different operator or workpiece. Sixth, workstations that are provided with tooling for manufacturing a particular product generally had the tooling affixed in a manner that makes it difficult to remove and replace with different tooling for another product. These disadvantages present significant difficulties in implementation of flexible manufacturing cell concepts and practices.

A need, therefore, exists for an infinitesimally adjustable-height work surface for a workstation that is very rugged in construction to accommodate relatively heavy workpieces and large forces, that can be adjusted quickly and easily to accommodate flexible manufacturing cell environments, and that is relatively inexpensive and easy to manufacture.

C. OBJECTS AND SUMMARY OF THE INVENTION

It is an object of the present invention to provide a workstation having a work surface that is infinitesimally adjustable in height with respect to a supporting floor.

It is another object of the present invention to provide an adjustable-height workstation that is ruggedly constructed and has a workpiece weight capacity and manufacturing force capacity exceeding 1000 pounds.

It is a further object of the present invention to provide a workstation in which an increase in a load force causes a corresponding increase in a work surface securing force to prevent slippage.

It is still another object of the present invention to provide a rugged, adjustable-height workstation that is relatively inexpensive to manufacture.

It is yet another object of the present invention to provide a workstation that facilitates the use of manufacturing tooling that can be easily removed and replaced to enable manufacturing of different products at the same workstation.

Accordingly, the present invention provides a workstation that is designed to be both height-adjustable for different operators and re-configurable for different products. In the preferred embodiment, the base structure of the workstation is constructed from a relatively inexpensive weldment and a vertical column composed of a standard structural steel I-beam. Only minimal machining of this I-beam is required to manufacture the workstation. A steel tooling plate is vertically disposed and mounted to the vertical column using channels such that it is able to slide vertically. A horizontal platform, along with the necessary support structure, is mounted to the vertical tooling plate to provide the work surface for the workpiece. Alternatively, a horizontal platform can be used that supports a conveyor when a part transport system is required. A locking wedge mechanism is located between the vertical column and the vertically disposed tooling plate to frictionally engage the surface of the column. This locking wedge allows the tooling plate to be positioned anywhere within a range along the vertical column and then locked. The vertical adjustment can be made using a hydraulic jack permanently attached to the workstation, or using a crane or forklift. The locking wedge mechanism allows for extremely heavy tooling or workpieces to be securely affixed to the vertical tooling plate, while maintaining its ability to be readily adjusted along the vertical column.

Another embodiment of the present invention provides a support structure for a work surface, the support structure including a beam having a length and a surface, a position securing apparatus, and a workpiece-supporting device. The workpiece-supporting device is configured to be slidably restrained to the beam and to be secured to the beam in selected positions along the length of the beam by the position securing apparatus. The position securing apparatus is configured to constrain the workpiece-supporting device in the selected position notwithstanding the presence of a load force having a line of action parallel to the longitudinal axis of the beam. The position securing apparatus is further configured to exert a constraining force that is proportional to the load force.

Still another embodiment of the present invention relates to a workstation including a means for supporting a workpiece, and a means for supporting the means for supporting the workpiece at a selected distance above a floor. The workstation also includes a means for frictionally securing the means for supporting the workpiece to the means for supporting the means for supporting the workpiece at the selected distance. The means for frictionally securing includes a first surface frictionally bearing upon a second surface.

Yet another embodiment of the present invention relates to a workstation including a vertically disposed support member and at least one generally vertically disposed tooling plate assembly. The tooling plate assembly includes a tooling plate and a position securing apparatus for securing the tooling plate in a selected vertical position with respect to and upon the support member. The position securing apparatus includes first and second wedging surfaces configured to cooperate in frictionally securing the tooling plate to the support member. The first and second wedging surfaces are disposed to be engaged in a downward direction of movement of one of the first and second wedging surfaces. An increase in downward force upon the tooling plate increases engagement of the first wedging surface with the second wedging surface and increases frictional securing force, the securing force thereby corresponding to the loading force.

D. BRIEF DESCRIPTION OF THE DRAWINGS

The features of the present invention which are believed to be novel are set forth with particularity in the appended claims. The invention itself, however, together with further objects and advantages thereof, may best be understood by reference to the following description when taken in conjunction with the accompanying drawings in which:

FIG. 7 is a partial, front elevational view of the tooling plate and wedge assembly illustrated in FIG. 6; and FIG. 8 is an exploded, partial perspective view of the wedge assembly illustrated in FIGS. 6 and 7.

E. DETAILED DESCRIPTION OF THE PREFERRED EMBODIMENTS

Figure 1:
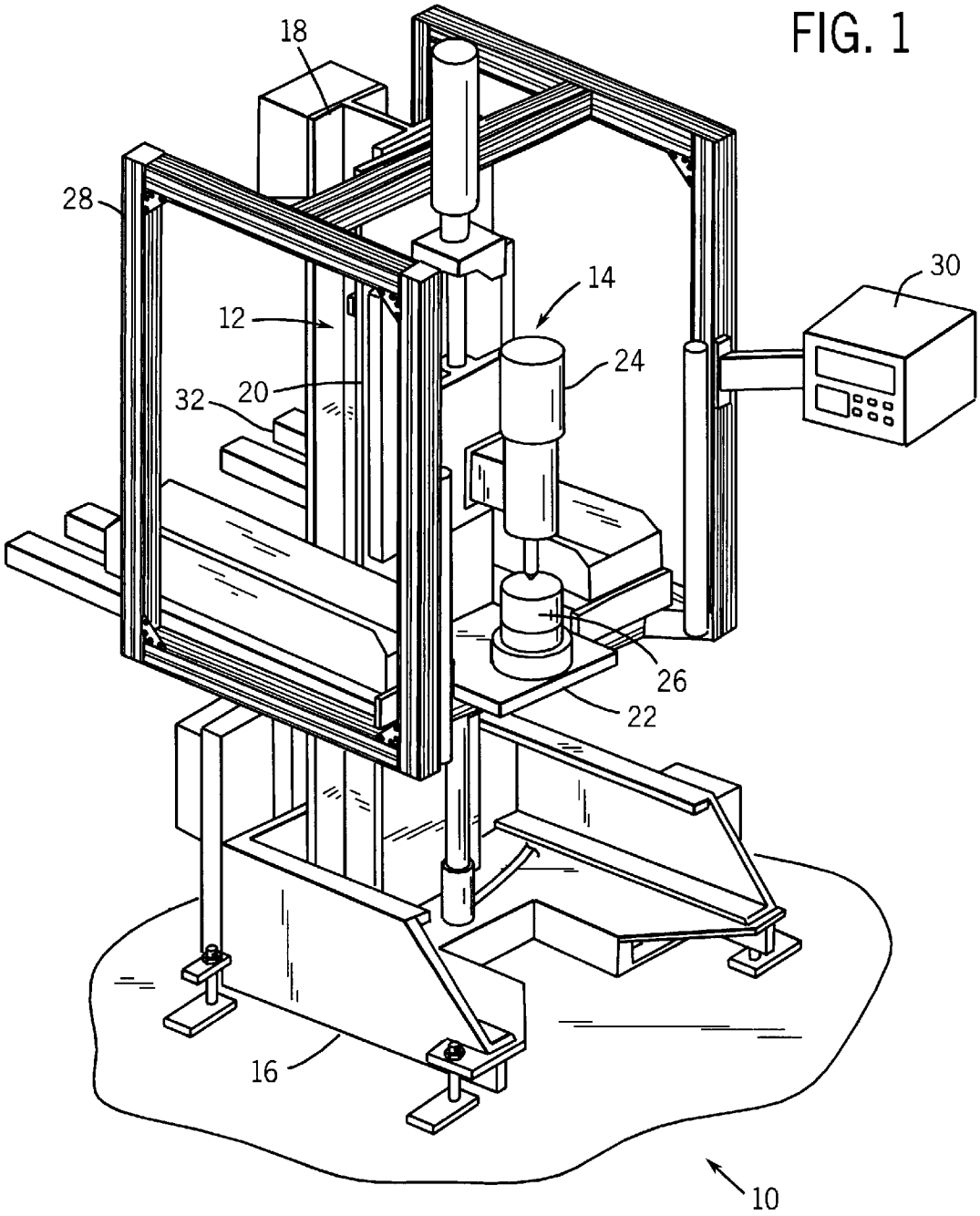
FIG. 1 is a perspective view of an exemplary embodiment of the invention showing a workstation having a work surface adjustable in height above a supporting floor, and having parts bins disposed for rear loading and unloading.

Referring now to the drawings, FIGS. 1 through 5 show a workstation 10 including a fixed support structure 12 and a movable support structure 14. Fixed support structure 12 comprises a base 16 and a support member 18. Since the preferred method of performing assembly operations is in the vertical direction, the support member 18 in the preferred embodiment is comprised of a beam or column that is configured to extend vertically up from the base 16. Movable support structure 14 functions as a backbone assembly and comprises a tooling plate 20, and typically includes either a worktable 22 or tooling 24, or both, affixed thereto. As known in the art, tooling 24 is used to perform machining or assembly operations upon a workpiece 26 mounted or resting upon worktable 22. Tooling 24 could be attached to or associated with either fixed support structure 12 or movable support structure 14, depending upon the particular workstation application. In the preferred embodiment, tooling plate 20 is oriented vertically instead of horizontally, since it is typically much easier to mount tooling 24 to a vertically oriented tooling plate in most workstation applications. However, as will be discussed below, the present invention is not limited to those workstations having a vertical tooling plate configuration.

Optional accessories may be attached to either fixed support structure 12 or movable support structure 14. In FIGS. 1–5, a safety guard structure 28, constructed from aluminum extrusion, is affixed to tooling plate 20 such that it moves vertically with the tooling plate. A process control and display unit (CDU) 30 may be attached to the guard structure 28. In another embodiment, the guard structure 28 is attached to the fixed support structure 12, either by mounting it to base 16 or to support member 18. In this embodiment, the guard structure 28 would be lifted away from the workstation 10 in order to change the tooling for a different application.

Figure 2:
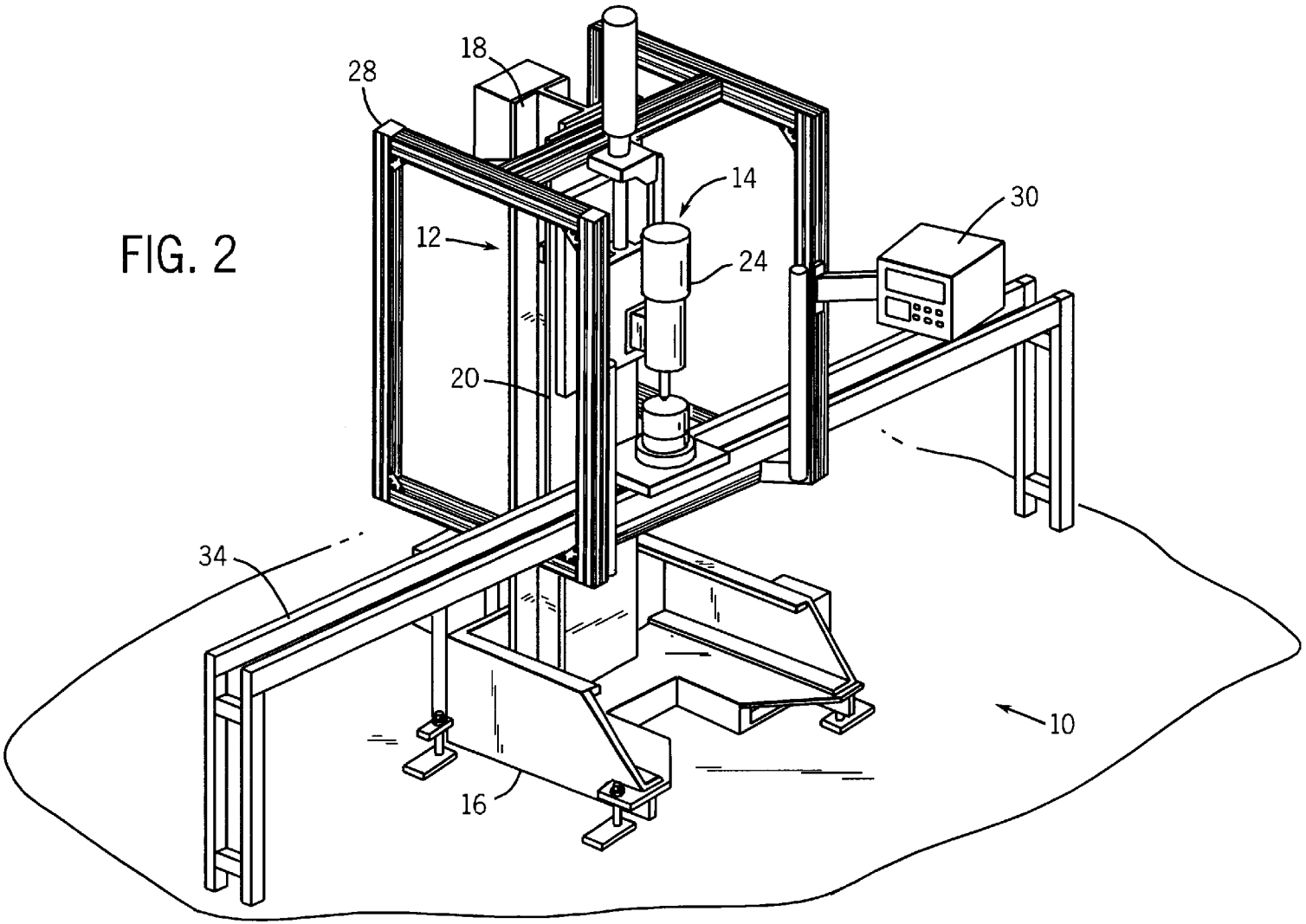
FIG. 2 is a perspective view of the embodiment of the workstation shown in FIG. 1, except having the parts bins replaced by a transversely disposed conveyor.

Other accessories can also be attached to either fixed support structure 12 or movable support structure 14, such as parts and product containers. The narrow width of support member 18 allows for parts to be fed on either side of the tooling plate 20. The configuration of FIG. 1 is also useful for modular assembly cells that have the required parts brought to the operator in bins 32. These bins are loaded into the workstation from the rear so that the assembly operation is not interrupted. In FIG. 2, a portion of the production line apparatus, shown as a workpiece conveyor 34, is designed to pass through the guard structure 28 for a different assembly application. Hence, as can now be appreciated, workstation 10 of the present invention is very flexible in its configuration such that it can readily be adapted for a wide variety of modular cell applications.

Figure 3:
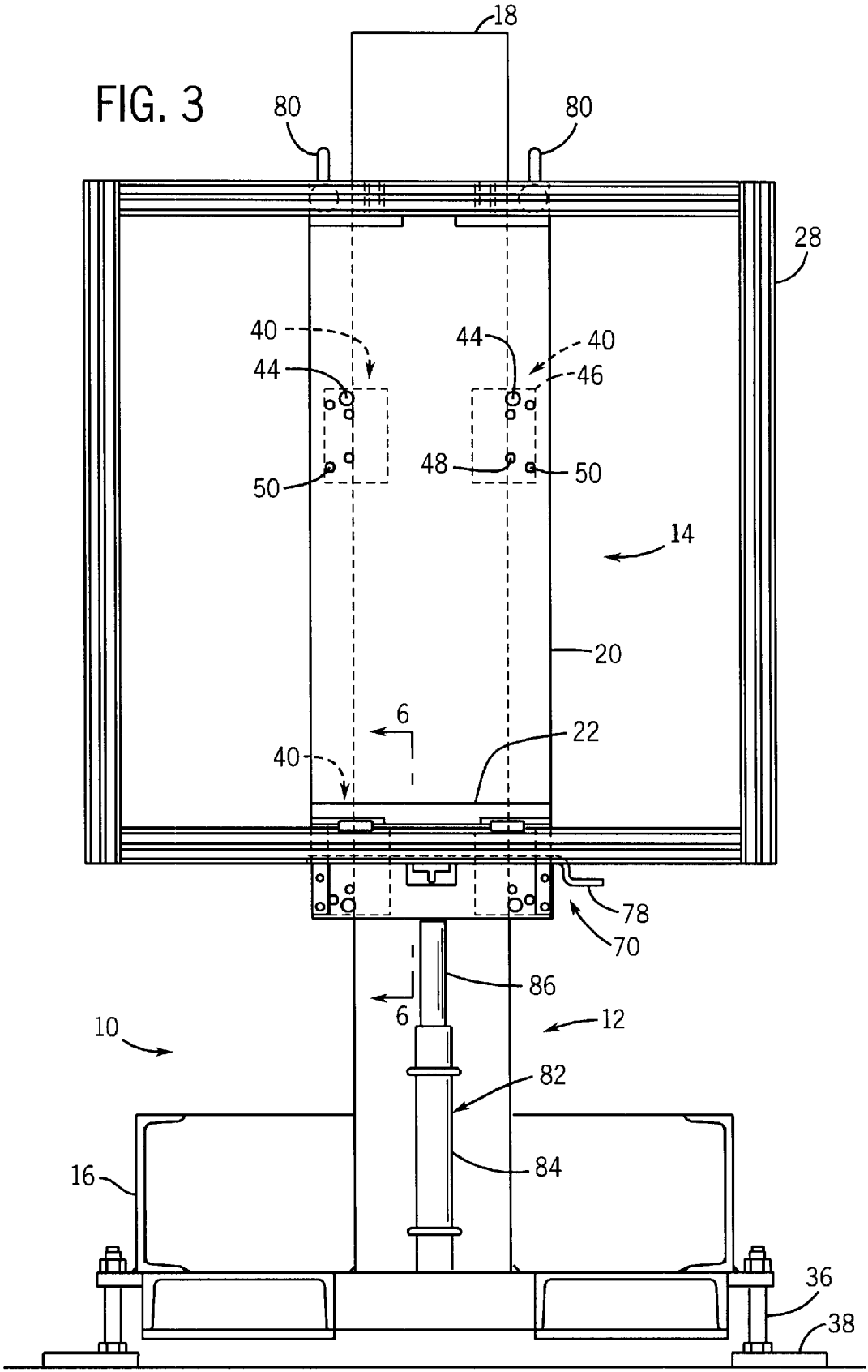
FIG. 3 is a front elevational view of the adjustable height workstation shown in FIG. 1.

As shown in FIG. 3, base 16 is preferably configured as a welded steel fabrication supported by leveling screws 36 positioned upon sole plates 38. The sole plates are securely mounted to the floor in compliance with Occupational Safety and Health Administration (OSHA) regulations. Base 16 may be fabricated of low-carbon steel plate and/or structural steel sections (e.g., channels or plates).

Support member 18 is comprised of an elongated structural member, such as a structural steel beam or column. In the preferred embodiment, support member 18 is a steel beam having wide flanges, such as a standard "I-beam" or "H-beam" that is typically used for columns in building construction. In an alternative embodiment (not shown), support member 18 may be constructed from any conventional wide flange beam, C-shaped or S-shaped beam stock, square or rectangular cross-section steel tube, etc. Support member 18 could also be comprised of a pair of separate parallel rails or ways, as known in the art. Support member 18 is rigidly affixed (e.g., by welding, using bolts, with brackets, etc.) to base 16. Additional gussets (not shown) may be added, if desired, to further secure support member 18 to base 16.

Movable support structure 14 is slidably engaged upon fixed support structure 12. As can most easily be seen in FIG. 4, tooling plate 20 in the preferred embodiment is attached to the vertical support member 18 using guiding assemblies 40 that grasp the inner edges 18*b* of the beam flanges in such a way that the tooling plate 20 can slide up and down. As will be described below, it is the combination of this guide assembly and a wedge assembly that engages with the I-beam and locks the tooling plate in a fixed position.

Figure 4:
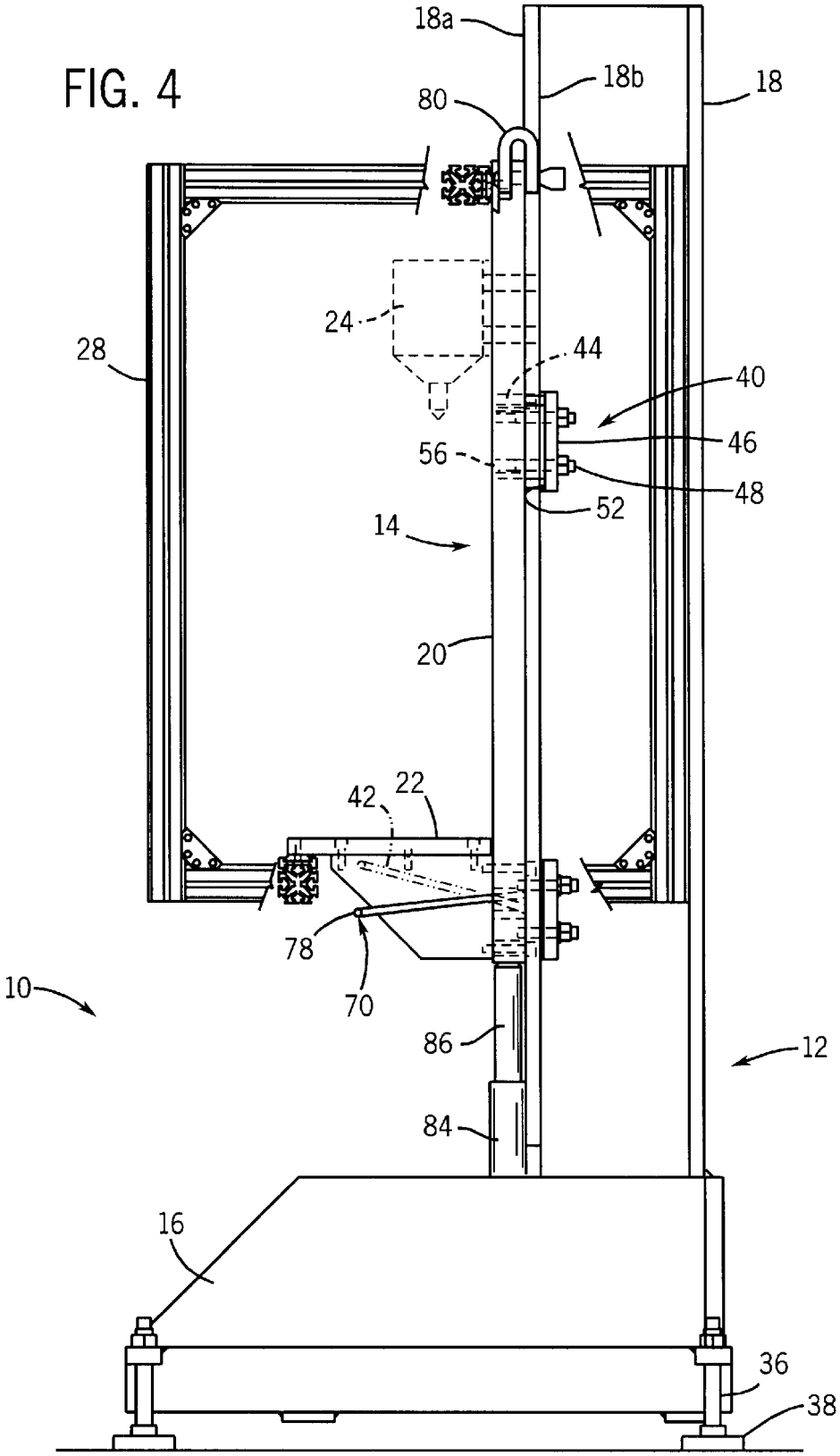
FIG. 4 is a side elevational view of the workstation shown in FIG. 1.
Figure 5:
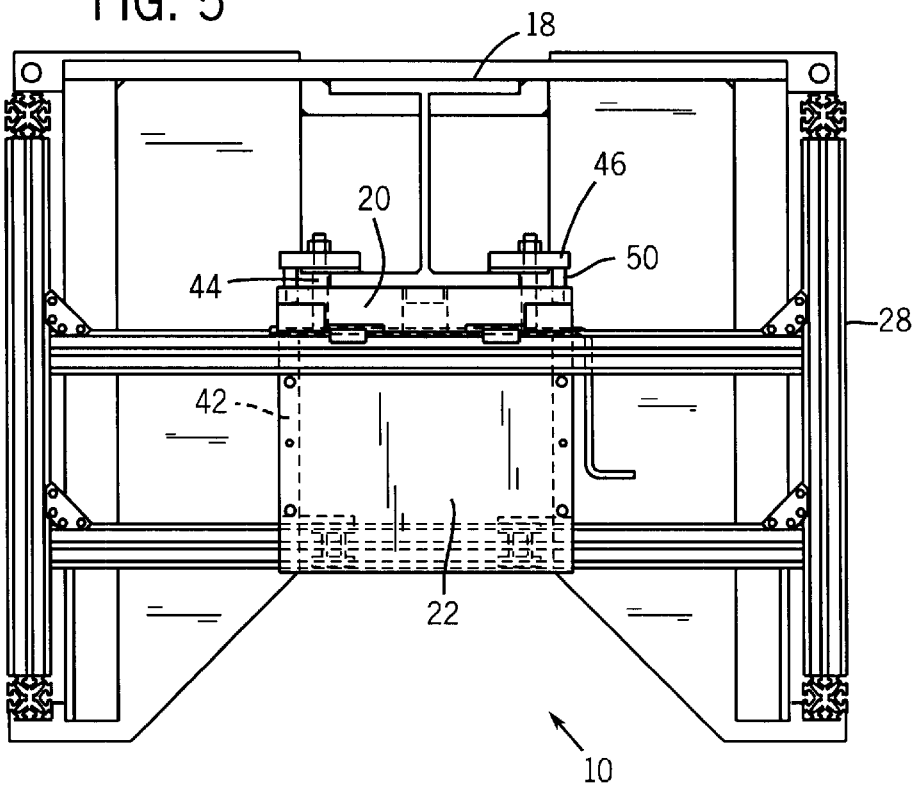
FIG. 5 is a top plan view of the workstation shown in FIG. 2.

In the preferred embodiment of the present invention, tooling plate 20 is fabricated from a steel plate. Horizontal worktable 22 is affixed to the vertically oriented tooling plate 20, as most clearly illustrated in FIGS. 3–6. Worktable 22 is also constructed of a steel plate. Worktable 22 is disposed on a pair of triangularly shaped support brackets 42 that are mounted to tooling plate 20 and worktable 22 using bolts, as shown in FIG. 4. Hence, worktable 22 will slide vertically along support member 18 with tooling plate 20. Tooling plate 20 also includes a plurality of threaded apertures to receive standard machine screws (not shown) for attachment of tooling 24.

As shown in FIGS. 1 and 4, both the tooling 24 and the worktable 22 are mounted to tooling plate 20 such that the entire movable support structure 14 moves vertically along the fixed support member 18. A major benefit of this configuration is that the workstation is easily retooled, i.e., when the modular cell system needs to be retrofitted for a new product, the new tooling is assembled on a second tooling plate and the entire backbone assembly unit is quickly exchanged for the old assembly unit. This is accomplished by removing the guard structure 28, lifting off the old movable support structure 14, and installing the new movable support structure.

In FIG. 2, tooling 24 is affixed to tooling plate 20, but no worktable 22 is used in this embodiment. Conversely, in FIG. 3, worktable 22 is affixed to tooling plate 20 but no tooling 24 is used. Hence, it can be seen that either or both the tooling 24 and/or worktable 22 can be mounted to the same tooling plate 20, or that two individual tooling plates could be used. Furthermore, depending upon the particular workstation application, the orientation of the tooling plate 20 may be changed. In the preferred embodiment, the tooling plate 20 is oriented vertically instead of horizontally, since it is typically much easier to mount tooling to a vertical tooling plate. However, the present invention is not limited to having a vertically oriented tooling plate configuration. For example, a horizontally mounted tooling plate configuration, where the longitudinal axis of the support member 18 is horizontal, would be preferable for horizontally disposed tooling such as a horizontal milling machine.

Figure 6:
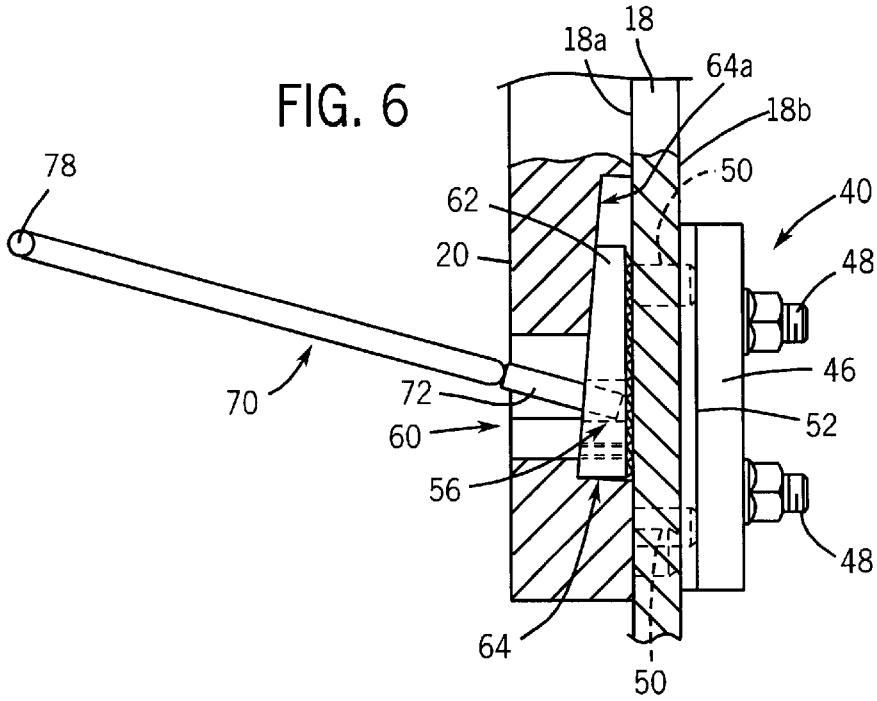
FIG. 6 is a partial, cross-sectional view of the tooling plate and wedge assembly taken across line 6—6 of FIG. 3.

FIGS. 6 and 7 illustrate how the tooling plate 20 is mounted to support member 18. Movable support structure 14 includes tooling plate 20 and at least two guiding assemblies 40, one on each side of the beam. In the preferred embodiment, four guiding assemblies 40 are used, each separated from the others on the tooling plate 20 as shown in FIG. 3. Each pair of guiding assemblies 40 is positioned on tooling plate 20 to engage the corresponding edges of the flanges of support member 18. Four large guide pins 44, each comprised of a dowel pin pressed into an aperture in the tooling plate 20 in an interference fit, serve to slide along the edges of the I-beam flange as the tooling plate 20 is raised and lowered. One guide pin 44 is positioned near each corner of the tooling plate 20, as shown in FIG. 3, such that they appropriately guide the tooling plate to prevent binding and misalignment.

Each guiding assembly 40 includes a clamping plate 46, two clamping screws 48, two pivot studs 50, and a bearing plate 52, as most clearly shown in FIG. 7. Each clamping plate 46 has two clearance holes 54 near its center line that are unthreaded and slightly larger in diameter than the major thread diameters of clamping screws 48 for passage of the clamping screws. Tooling plate 20 includes corresponding threaded apertures 56 for receiving threaded portions of clamping screws 48. Pivot studs 50 are threaded into tooling plate 20 as shown, such that they are positioned near the outermost edge of the clamping plate 46. Finally, bearing plate 52, having two clearance holes 58 similar to those of clamping plate 46, is positioned between the rear face of the tooling plate 20 and the clamping plate 46. Bearing plate 52 is constructed of a material having a low coefficient of friction and a relatively high wear rate, such as an ultra-high molecular weight (UHMW) polymer. One surface of bearing plate 52 is clamped against the flange of I-beam 18 by the clamping plate 46.

Using this configuration, the tooling plate 20, clamping plate 46, clamping screw 48, pivot stud 50, and bearing plate 52 cooperate to form guiding assembly 40 which can be closed by tightening clamping screws 48. This causes the outer side of clamping plate 46 to pivot about the outermost tip of pivot stud 50 and the inner side of the clamping plate 46 to press the bearing plate 52 against the inner side of the flange of I-beam 18 to form a channel guide. This guiding assembly, in conjunction with guide pins 44, allows the tooling plate 20 to be movable and positioned anywhere along the center portion of I-beam 18 without an undesirably large amount of lateral play or looseness. As will be seen below, the weight of the tooling plate 20 is supported by a wedge-shaped piece of steel that is trapped between the front face 18*a* of I-beam 18 and a rear surface 20*b* of tooling plate 20.

As shown in FIGS. 6 through 8, movable support structure 14 also includes a wedge assembly 60 which, in the preferred embodiment, is housed within a lower portion of tooling plate 20. Wedge assembly 60 includes a wedge plate 62 and a recess or pocket 64 disposed within the rear surface 20*b* of tooling plate 20, which is facing the front surface 18*a* of I-beam 18. The recess floor 64*a* of pocket 64 is generally flat but is sloped at a predetermined angle from the rear surface 20*b* of tooling plate 20. Wedge plate 62 is housed within pocket 64. Wedge plate 62 also has a sloping surface 62*a* having an angle complementary to that of recess floor 64*a*. As will be seen below, recess floor 64*a* functions as a first wedging surface, and the sloping surface 62*a* of wedge plate 62 functions as a second wedging surface. In the preferred embodiment, the rear surface 62*b* of wedge plate 62 is serrated to ensure that the wedge plate does not slip along the front surface 18*a* of the I-beam 18.

FIG. 7 illustrates that wedge plate 62 is disposed inside pocket 64 and arranged such that the wider portion of both pocket 64 and wedge plate 62 are oriented downwards. If wedge plate 62 is moved upwardly, the corresponding sloping surface 62*a* and recess floor 64*a* force the tooling plate 20 to move perpendicularly away from the front face

18*a* of the beam. As this occurs, guiding assemblies 40 prevent tooling plate 20 from moving further away, and the rear surface of wedge plate 62 pressing against the front surface 18*a* of tooling plate 20 secures the movable support structure 14 to the I-beam support member 18. The orientation of wedge plate 62 and pocket 64 are selected so that an increase in downward force upon tooling plate 20 will also cause wedge plate 62 to bear more firmly against surface 18*a* of I-beam 18, thereby increasing the frictional force constraining tooling plate 20. In other words, wedge assembly 60 is constructed and arranged such that any further downward motion of tooling plate 20 (parallel to the longitudinal axis of the I-beam 18) applies even more force to wedge plate 62 against the beam 18. Therefore, the more force that is applied to the tooling plate 20 substantially along the longitudinal axis of I-beam 18, either due to the weight of the workpiece 26 or the force of the tooling 24, then the tighter wedge plate 62 will lock against front surface 18*a* of the I-beam 18. Wedge assembly 60 is thereby self-tightening.

Wedge assembly 60 also includes a release lever 70 having its center portion clamped to the front face 20*a* of tooling plate 20. In the preferred embodiment, release lever 70 is constructed of ⅜-inch diameter hot rolled steel bar stock. As shown in FIG. 8, the center portion of release lever 70 includes a tab or tongue 72 that engages a slot 74 in wedge plate 62, since tooling plate 20 has a cutout 76 through which tongue 72 is projected through pocket 64 into to wedge plate 62. In the preferred embodiment, one end of release lever 70 is offset to one side of tooling plate 20 and formed as a handle 78.

When the operator lifts handle 78 of release lever 70 upwardly, tongue 72 and wedge plate 62 are forced downwardly, thereby disengaging rear surface 62*b* from beam surface 18*a* in preparation for repositioning tooling plate 20 to a new height. After the wedging action has been released, tooling plate 20 can be raised or lowered to any point along the center-working portion of the I-beam 18. Similarly, if tooling plate 20 itself is raised, wedge plate 62 moves downwardly relative to tooling plate 20 and the wedging action is also removed.

Conversely, if the operator presses downwardly on handle 78 of release lever 70, tongue 72 and wedge plate 62 are forced upwardly, thereby engaging first sloping surface 62*a* with recess floor 64*a* to tightly engage wedge plate 62 against front surface 18*a* of I-beam 18. Once wedge plate 62 is raised into place, any downward motion of tooling plate 20 will further force rear surface 62*b* against beam surface 18*a* and prevent any further motion of tooling plate 20. Hence, the force of gravity on movable support structure 14 and/or the force applied by tooling 24 against worktable 22 (if they are not affixed to the same tooling plate 20) will serve to further increase the securing force directly against the surface of I-beam 18 and further decrease the ability of the movable support structure 14 to slip.

Note that the coefficient of static friction of wedge plate 62 upon I-beam 18, and, similarly, the force securing the position of tooling plate 20, can be increased by texturing either the rear surface 62*b* of wedge plate 62 or the front surface 18*a* of I-beam 18. In the preferred embodiment, the rear surface of wedge plate 62 includes transverse serrations or diamond knurling or some other texturing, such that no additional machining has to be done to I-beam 18.

Also note that one of the principal aspects of the present invention is the correspondence of sloping surface 62*a* and 64*a*. Note that if corresponding sloping surfaces were not used, then any downward force on tooling plate 20 would just try to pry the bottom portion of tooling plate 20 away from beam 18, acting unevenly against only two guiding assemblies 40. Furthermore, the downward force of tooling plate 20 would not be translated by 90 degrees to be applied evenly as a normal force against the I-beam surface 18*a* or distributed evenly across the rear surface 62*b* of the wedge plate 62. Although this uneven application of forces may work in some light-duty applications, it is preferable that the force provided by the wedge plate 62 be applied approximately normal to the face of the I-beam, i.e., 90 degrees to the longitudinal axis of support member 18.

One skilled in the art may further note that the use of a recess or pocket 64 in the back surface of the tooling plate 20 is not the only way to form a second sloping surface. It should be understood that an additional wedge plate may be affixed to the rear surface 20*b* of the tooling plate 20 to provide the second sloping surface. Moreover, a simple angled cut-off of the lower edge of the tooling plate 20 could alternatively be used, and perhaps be the most economical approach. In the preferred embodiment, the sloping surface is at an angle of approximately 4 degrees from the longitudinal axis of the I-beam 18. However, it is contemplated that any angle within the range of 2 degrees to 30 degrees would also serve the function of efficiently translating the downward forces applied to the tooling plate into inward forces applied against the I-beam. In the preferred embodiment, angles of 10 degrees or less are favored.

The use of recess or pocket 64, however, provides an additional advantage in the preferred embodiment. The use of pocket 64 also serves to enclose wedge plate 62 such that it remains in the correct position and orientation between the tooling plate 20 and the I-beam 18 at all times, whether or not the tongue 72 of lever arm 70 are designed to serve this purpose. In the preferred embodiment, pocket 64 also holds wedge plate 62 during assembly of the wedge assembly 60. However, if a pocket is not used, wedge plate 62 can be held in place with a flexible cord or spring or equivalent.

Movable support structure 14 is typically too heavy to be repositioned manually by the operator. This would most certainly be the case with worktable 22, tooling 24, and safety guard structure 28 installed on tooling plate 20. Therefore, several mechanisms have been provided to raise and lower movable support structure 14. These mechanisms may also be used to replace the tooling plate 20 with another tooling plate for a different operation at the same workstation.

In the preferred embodiment, tooling plate 20 includes one or two lifting eyes, shown in FIG. 3 and FIG. 4 as shackles 80. These shackles would be attached to a shop crane, or block and tackle, or other overhead lifting apparatus to raise and lower the backbone assembly. Tooling plate 20 may also be provided with lifting pockets (not shown) to facilitate engagement of a lift truck to provide for raising or lowering tooling plate 20 to a new position.

If the tooling or worktable height is to be adjusted more frequently, such as the situation where there is a large amount of human operator intervention required at a particular workstation, an alternative lifting apparatus can be used. As shown in FIGS. 3 and 4, a hydraulic or air cylinder assembly 82, having a cylinder 84 and a rod 86 powered by an external hydraulic or air powered unit (not shown), is provided under tooling plate 20 for adjusting the height of the movable support structure 14. Alternatively, any other type of jack apparatus, even an automobile jack, could be used.

Accordingly, after the height of tooling plate 20 is adjusted using cylinder assembly 82, the operator would push handle 78 downward to engage wedge plate 62. The operator would then release the force from cylinder assembly 82, whereupon gravity acting on the movable support structure 14 would cause the complementary sloping surfaces of the wedging assembly 60 to force rear surface 62*b* of wedge plate 62 tighter against the surface 18*a* of the I-beam 18. This action locks tooling plate 20 into the desired new position. As mentioned above, any additional downward forces, caused either by the weight of workpiece 26 resting on worktable 22, or by the forces applied by separately mounted tooling 24 against workpiece 26, would cause wedge plate 62 to grip tighter. Hence, even though the movable support structure 14 is adjustable to an infinite number of positions within the I-beam adjustment range, the present invention provides a locking function that is extremely strong. In the preferred embodiment, the wedge assembly 60 can support a load of over 1000 pounds without slipping.

The present invention may be used in a variety of other tooling and assembly cell configurations. In particular, support member 18 does not have to be vertical as in the preferred embodiments. It is contemplated that the same wedge assembly 60 could be used with a horizontal beam orientation for use with horizontal milling or drilling machining applications. Although the vertical force of gravity will not be assisting to increase the wedging and locking forces in a horizontal orientation, the horizontal force applied by the tooling against the workpiece would serve to do so.

The dimensions of the workstation of the preferred embodiment are as follows:

Base 16: 964 mm wide by 900 mm deep by 362 mm high;

Support member 18: 250 mm wide by 265 mm deep by 2000 mm high;

Tooling plate 20: 395 mm wide by 1225 mm tall by 48 mm thick;

Worktable 22: 390 mm wide by 305 deep by 25 mm thick;

Safety guard structure 28: 1000 mm wide by 1100 mm tall by 700 mm deep;

Worktable support bracket 42: 250 mm deep by 155 mm high by 25 mm thick with 45 degree angle from the far edge;

Bearing plate 52: 148 mm tall by 76 mm wide by 6.4 mm thick;

Wedge plate 62: 76 mm wide by 95 tall by 21 mm thick at bottom (thickest) tapering at 4 degrees to 14 mm thick at top (thinnest) and having a tongue slot of 36 mm wide by 17 mm high, and having 6 mm by 6 mm wide by 3 mm tall cross-hatched points on the rear surface.

Lever arm 70: 425 mm long (central part) with 200 mm arm with 65 mm handle made of 10 mm diameter rod;

Lever arm tongue 72: 46 mm long by 28 wide by 10 mm thick;

Tooling plate pocket 64: 90 mm wide by 125 mm tall by 22 mm deep at bottom of wedge (deepest) sloping at 4 degrees to top of the wedge (shallowest);

Tooling plate cutout 76: 64 mm wide by 75 mm tall;

Hydraulic cylinder assembly 82: 400 mm high when at the bottom of stroke, and add 305 mm when at the top of stroke.

While specific embodiments of the present invention have been shown and described herein, further modifications and improvements may be made by those skilled in the art. In particular, it should be noted that more than one tooling plate assembly could be used on the same beam to hold both the tooling and the workpiece. Moreover, a tooling plate 20 may be placed on both the front and rear sides of a single beam. Support member 18 may also be disposed horizontally upon or above a floor, and wedge assembly 60 used to secure position against a load force not related to weight. Numerous modifications may also be made to customize the present invention for various other applications. All such modifications, which retain the basic underlying principles disclosed and claimed herein, are within the scope and spirit of the invention.

What is claimed is:

1. An adjustable workstation, comprising:

a fixed support structure;

a movable support structure movably engaged with the fixed support structure, the movable support structure including a rear portion facing the fixed support structure and a front portion substantially opposite the rear portion;

a first wedge surface coupled to the rear portion of the movable support structure and having a slope relative to the fixed support structure;

a second wedge surface located between the first wedge surface and the support structure, the second wedge surface cooperating with and complementary to the first wedge surface, wherein a force in a first direction on the second wedge surface relative to the first wedge surface results in a constrainment of the movable support structure relative to the fixed support structure, and wherein a force in a second direction substantially opposite the first direction on the second wedge surface relative to the first wedge surface results in a release of constrainment of the movable support structure relative to the fixed support structure.

2. The adjustable workstation of claim 1, wherein the second wedge surface is located on a first wedge plate between the tooling system and the support system.

3. The adjustable workstation of claim 2, wherein the first wedge surface is located on the rear portion of the tooling system.

4. The adjustable workstation of claim 3, wherein the rear portion of the tooling system comprises a second wedge plate fixedly attached to the front portion of the tooling system.

5. The adjustable workstation of claim 3, wherein the tooling system includes a recess in the rear portion thereof, the rear portion including the first wedge surface for interaction with the second wedge surface.

6. The adjustable workstation of claim 2, further comprising a lever having first and second ends, the lever coupled to the second wedge surface at the second end thereof such that a force on the first end of the lever results in a substantially opposite force on the second wedge surface.

7. The adjustable workstation of claim 2, further comprising a worktable coupled to the tooling system.

8. The adjustable workstation of claim 2, further comprising a tool for interacting with a workpiece, the tool coupled to the tooling system.

9. The adjustable workstation of claim 2, further comprising a guard structure coupled to the tooling system.

10. The adjustable workstation of claim 2, further comprising a plurality of guiding assemblies coupled to the tooling system, the guiding assemblies cooperating with a plurality of inner edges of the support system to slidably engage the tooling system with the support system.

11. The adjustable workstation of claim 2, further comprising means for altering the position of the tooling system relative to the support system.

12. An adjustable workstation, comprising:

a base;

a support member coupled to the base;

a tooling plate having a rear surface facing the support member and a front surface substantially opposite the rear surface, the tooling plate including a recess disposed within the rear surface thereof, the recess defining a sloped surface relative to the rear surface, the tooling plate slidably engaged with the support member; and a wedge plate disposed within the recess and having a sloped surface complementary to the sloped surface of the recess, wherein a movement of the wedge plate in a first direction relative to the recess results in the sloped surfaces of the recess and the wedge plate cooperating to inhibit movement of the tooling plate relative to the support member and wherein a movement of the wedge plate in a second direction substantially opposite the first direction relative to the recess results in the sloped surfaces of the recess and the wedge plate cooperating to uninhibit movement of the tooling plate relative to the support member.

13. The adjustable workstation of claim 12, further comprising a lever arm having a free end and a fixed end coupled to the wedge plate, wherein a movement of the free end in a third direction results in a movement of the wedge plate in a fourth direction substantially opposite the third direction.

14. The adjustable workstation of claim 13, further comprising a tool coupled to the tooling plate.

15. The adjustable workstation of claim 14, further comprising a worktable coupled to the tooling plate.

16. The adjustable workstation of claim 13, further comprising a hydraulic assembly coupled to the tooling plate, the hydraulic assembly selectively repositioning the tooling plate relative to the support member.

17. The adjustable workstation of claim 13, further comprising an air cylinder assembly coupled to the tooling plate, the air cylinder assembly selectively repositioning the tooling plate relative to the support member.

18. The adjustable workstation of claim 13, further comprising a guard frame coupled to the tooling plate.

19. The adjustable workstation of claim 13, further comprising a plurality of guiding assemblies coupled to the tooling plate, the guiding assemblies cooperating with a plurality of inner edges of the support member to slidably engage the tooling plate with the support member.

20. The adjustable workstation of claim 13, further comprising a jack assembly coupled to the tooling plate, the jack assembly selectively repositioning the tooling system relative to the support member.

* * * * *